United States Patent [19]

Berry et al.

[11] Patent Number: 4,643,432

[45] Date of Patent: Feb. 17, 1987

[54] CHECKER TYPE GAME UTILIZING INTERFITTING GAME PIECES

[75] Inventors: William J. Berry, 532 Jefferson, Lake Geneva, Wis. 53147; Michael H. McManigan, Ogdensburg, Wis.

[73] Assignee: William J. Berry, Lake Geneva, Wis.

[21] Appl. No.: 683,221

[22] Filed: Dec. 18, 1984

[51] Int. Cl.[4] ..... A63F 3/00

[52] U.S. Cl. ..... 273/260; 273/290

[58] Field of Search ..... 273/260, 258, 290, 261, 273/262, 288, 291

[56] References Cited

U.S. PATENT DOCUMENTS

| | | | |
|---|---|---|---|
| 621,799 | 3/1899 | Degges | 273/260 |
| 2,610,060 | 9/1952 | Powell | 273/290 X |
| 2,896,950 | 7/1959 | Rosti et al. | 273/290 X |
| 3,751,039 | 8/1973 | Dykoski | 273/290 X |
| 4,173,347 | 11/1979 | Field, II | 273/261 |
| 4,239,230 | 12/1980 | Shoptaugh | 273/264 |

FOREIGN PATENT DOCUMENTS

| | | | |
|---|---|---|---|
| 8100968 | 4/1981 | PCT Int'l Appl. | 273/260 |
| 1427860 | 3/1976 | United Kingdom | 273/290 |

*Primary Examiner*—Richard C. Pinkham
*Assistant Examiner*—Matthew L. Schneider
*Attorney, Agent, or Firm*—Paul H. Gallagher

[57] ABSTRACT

A game board, similar to a checker board, includes 10 squares on edge, and two sets of playing pieces, moved by opposing players on opposite sides of the board. Each player moves his pieces against the other's, and upon encounter, captures the respective pieces. The pieces are respectively pegs and rings, and upon capture, the pieces involved—a peg and a ring—are interfitted in vertically stacked position, to show the capture. The upper piece is the captor, and the lower piece the captive. A captive piece can be re-captured, and that step indicated by a piece like the original captive piece, put atop the first captor piece.

6 Claims, 10 Drawing Figures

Fig. 1
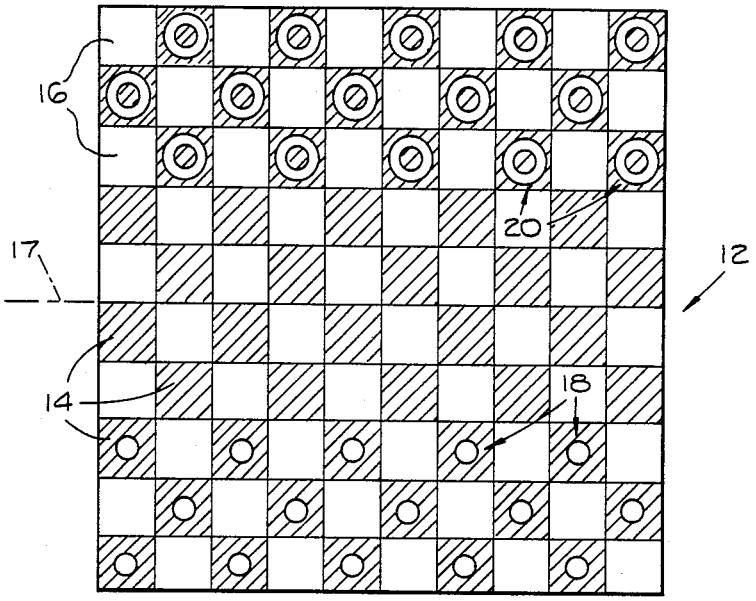
Fig. 2
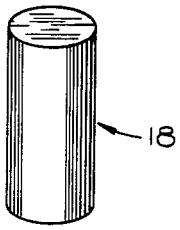
Fig. 3
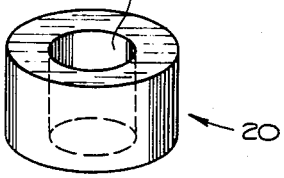
Fig. 4
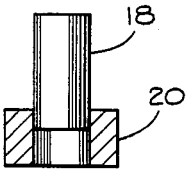
Fig. 5
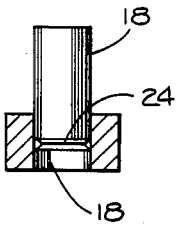
Fig. 6
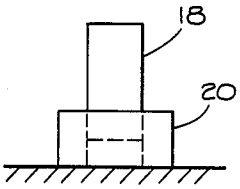
Fig. 7
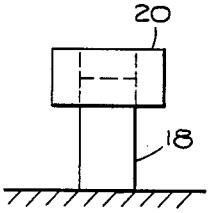
Fig. 8
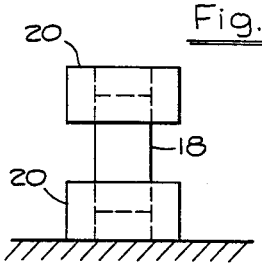
Fig. 9
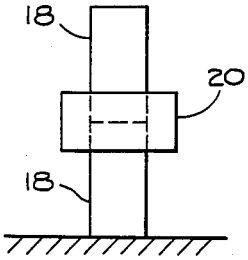
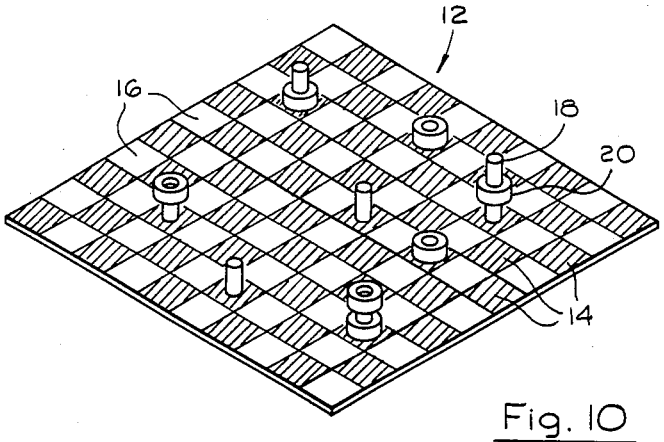
Fig. 10

CHECKER TYPE GAME UTILIZING INTERFITTING GAME PIECES

FIELD OF THE INVENTION

The invention resides in the field of games, of the kind including a board and playing pieces thereon. The playing pieces are of two kinds, played by opposing players at opposite sides of the board, which is similar to a checkerboard, each moving his piece against the other, toward the opposite side of the board, attempting to capture those of the opponent.

OBJECTS OF THE INVENTION

A broad object of the invention is to provide a game of the kind including a board and pieces which opposing players move toward each other, having the following features and advantages:

1. Pieces on one side can be captured by those on the other, and the pieces involved in the capture are fitted together to so indicate the capture, and which piece is the captor and which the captive.
2. Pieces once captured can be re-captured.
3. The pieces are of novel construction enabling them to be iterfitted, to show capture, in either of opposite senses, and in a re-capturing sense, and the pieces are of attractive form, both as individual pieces and in interfitted form.

DESCRIPTION OF A PREFERRED EMBODIMENT

In the drawings,

FIG. 1 is a plan view of the game board, and playing pieces thereon;

FIG. 2 is a perspective view of a playing piece of one of the two sets of such pieces;

FIG. 3 is a perspective vidw of a playing piece of the other of the two sets;

FIG. 4 is a view of a piece of each of the two sets fitted together, showing one of them in section;

FIG. 5 is a view similar to FIG. 4, showing an alternate form of construction;

FIG. 6 is a side view of pieces of the two sets, fitted together in one position;

FIG. 7 is a view of the pieces of FIG. 5 fitted together in an opposite position;

FIG. 8 is a side view of the pieces of FIG. 5 with another piece fitted therewith;

FIG. 9 is a view similar to FIG. 6 and including an additional piece fitted therewith; and FIG. 10 is a perspective view of a playing board with certain of the playing pieces thereon, and with certain of them in different combinations fitted together.

The game includes a game board 12 which is similar to a checkerboard, in that it has alternate dark and light squares 14, 16, respectively, but the game board in the present case includes ten squares on edge.

The game also includes two sets of playing pieces 18, 20, respectively, those of each set being different from those of the other set as will be referred to again hereinbelow. There are fifteen playing pieces in each set, which may be referred to as pieces, or men, which are placed on the respective squares, and occupy three rows when all placed on the board on adjacent squares. The two kinds are placed respectively on opposite sides of the board, to be moved by opposed players stationed at those sides, and each side has two vacant rows adjacent the middle. FIG. 1 shows a line 17 at the middle of the board. The players may be designated Player A and Player B, for convenience.

FIG. 2 shows in perspective view, one of the playing pieces 18, of one of the sets, cylindrical in shape, in the form of a peg or pin.

FIG. 3 is a perspective view of one of the playing pieces 20, of the other set, which is in the form of a annulus, or ring, having a central hole 18.

The pieces are interfitted, in various phases of the game, as shown in FIGS. 4–8. The interfitted pieces are referred to as a "playing piece unit" for convenience. In general, the pieces are dimensioned for free sliding relative to each other, for ease in playing, but may be friction fitting after moving to a final position. This relationship may constitute one form, represented in FIG. 4. In this case, the pieces may be tapered, to assure limit positioning, when so fitted. As an alternative, the surface of the hole 22 may be provided with a rib 24, as in FIG. 5, to limit the extent of telescoping. The peg 18 should not extend more than half way through the ring, to enable a peg to be fitted in the opposite side, as in FIG. 9.

The playing pieces 18, 20 may be made of any suitable material, such as plastic, or of course of other materials. In the playing of the game, described hereinbelow, the pieces 18, 20 are placed on the respective squares on the playing board as illustrated in FIG. 1. Broadly stated, one of the principal features of the game is that the two pieces 18, 20 of the different sets can be interfitted to indicate a capturing step.

For this purpose the peg 18 is inserted into the hole 22 of the ring 20, or, to be interpreted in another sense, the ring is fitted over the peg. In the capturing of an opposing piece, and the peg is fitted into the ring, or the ring fitted over the peg, the interfitted pieces then remain in stationary and stable position. The playing pieces 18, 20 may assume desired dimensions for the sake of appearance, and of stability, both when the pieces are standing alone, or in interfitted position. While the invention of course is not limited to any specific proportions and dimensions of the playing pieces, the following dimensions have proved practical: in the ring, the inside diameter equals the height, or axial dimension, and each of those dimensions equals the radius; in the peg, the diameter substantially equals the radius of the ring and its height equals the outside diameter of the ring, and the diameter of the peg is of course substantially equal to the inside diameter of the ring. Converting these proportions to an example of actual dimensions, a diameter of the ring is assumed to be $1\frac{1}{2}''$, and the inner diameter is $\frac{3}{4}''$, and the height or axial dimension is $\frac{3}{4}''$; in the peg, its diameter is $\frac{3}{4}''$ and its height $1\frac{1}{2}$ inches.

Playing of the game may assume various specific forms, several of which are referred to again hereinbelow. In general, each player's pieces are moved toward the other's alternately, one square at a time, and as the pieces approach each other, and are in squares next to each other, one player's piece moves into the square occupied by the opponent's piece, and establishes a captor/captive relationship. This is done by fitting the pieces together. Assuming that at this point it is the turn of Player A to move, he fits the peg 18 into the hole of Player B's ring 20. Such a position is shown in FIG. 6. This position indicates such capture, and the uppermost piece, or the peg 18, is the captor piece, and the lower piece, or ring 20, is the captive piece. These pieces, arranged in a vertical stack, are then treated according to the specific rules of the particular game being played.

In a similar play in the opposite direction, i.e., Player B, in performing a capturing step, fits the ring 20 over the opposing peg 18, as represented in FIG. 7, and in this case also, the upper piece indicates the captor piece; thus the ring 20 is the captor piece and the peg 18 the captive piece.

The rules of the game also provide for re-capturing. Referring first to the relationship of FIG. 6, where the peg 18 is the captor piece, Player B can re-capture the stack. In doing this, he places a ring 20 over the peg 18 that was the previous captor piece, as in FIG. 8, and recaptures the stack, which of course results in re-capturing his own piece 20 that was lowermost in FIG. 6. As a result of this re-capturing step, the ring 20 is the uppermost piece and it controls the stack.

A similar situation exists in the opposite direction of playing, and in this case attention is directed to FIG. 9. Referring to the stack of FIG. 7, where the lower piece, or peg 18, is captured, Player A can, in proper circumstances re-capture, i.e., by placing a peg in the ring 18 which was uppermost (FIG. 7) resulting in a three-piece stack of FIG. 9, where a peg 18 is again uppermost, and controls the stack.

The dimensions of the pieces, indicated above, provide stability to the pieces not only when resting alone, but also when interfitted in any of the combinations referred to. First, the peg 18 having a diameter equal to half its length, will be stable when set upright, and obviously when the peg is inserted into the hole of the ring, with the ring lowermost (FIGS. 4–6), the relatively greater diameter of the ring provides stability. In the case where the ring is fitted over the upper end of the peg (FIG. 7), the stack is also stable, since the diameter of the peg is substantial, being one half the diameter of the ring. The same holds true as in the case of FIG. 9 even though a second peg 18 is uppermost, and the stack rests on a peg. In this case the height is slightly more than 3", but the diameter of the peg, $\frac{3}{4}$" retains the stack in stable position.

The overall dimensions of the playing pieces, maintaining the desired proportions therebetween, may be in proportion to the dimensions of the game board itself, such for example as having the ring of less diameter than the edge of a square on the board.

Reference is now made to the rules of play of certain specific forms of game.

The following are specific games to be played with the foregoing game device:

ACONS—Game #1

15 pieces per side, placed on outer rows, on all squares, occupying three rows per side, four middle rows vacant.

1. Primary pieces move forward, single space diagonally.
2. When confronted, capture of opponent must take place; capture is accomplished by stacking action, captor on top.
3. Captive pieces are frozen in place.
4. Play continues until no moves are available to one contestant.
5. Score as follows: Captor and Primary pieces score one point for each row of penetration on opponent's side of the board.

CAPONS—Game #2

15 pieces per side, placed on outer rows, on all squares, occupying three rows per side, foud middle rows vacant.

1. Primary pieces move forward, single space diagonally.
2. When confronted, capture of opponent must take place; capture is accomplished by stacking action, captor on top.
3. Captive pieces are now second level and may move any diagonal direction one space at a time.
4. Second level pieces may jump opponent's pieces to vacant squares, causing jumped piece to be removed from the board.
5. More than one piece may be jumped in a single move if they are separated by single vacant adjacent squares.
6. If a primary piece captures a second level piece, the second level piece is turned over, reversing ownership and the attacking primary piece is retired from the board.
7. Game ends when one opponent can make no move or when no improvement of score can be made by one opponent.
8. Scoring is as in ACONS #5 above.

PACONS—Game #3

16 pieces per side, rings vs. pegs.

1. Pieces move one space per move any diagonal direction. (Except as in #5)
2. Squares are captured by nesting.
3. Pieces on captured squares do not move.
4. Capturing is done on forward or back motion, only.
5. Adjacent captured pieces, belonging to the same side, may be passed over in one move, in series, to re-position action piece, or to capture (fowward or backward only) any un-engaged opposing piece.
6. Side movement of pieces is limited to vacant spaces or to captured spaces on the same side.
7. Scoring: Penetration and Capture in opponent's half of the board scores one point for each row. Game ends when one player has no moves left to make.

RACONS—Game #4

1. Pieces move one space per move any diagonal direction.
2. Squares are captured by nesting.
3. Pieces on captured squares do not move.
4. Capturing is done on forward or back motion, only.
5. Adjacent captured pieces, belonging to the same side, may be passed over in one move, in series, to re-position action piece, or to capture (forward or back only) any un-engaged opposing piece.
6. Side movement of pieces is limited to vacant spaces or to captured spaces on the same team.
7. Scoring: Penetration and Capture in opponent's half of the board scores one point for each row. Game ends when one player has no moves left to make.
8. Pieces may be re-captured by placing additional pieces on top of captured pieces, thus neutralizing opponent's score on your side of the board or scoring appropriate points for you if on opponent's side.

We claim:

1. A game comprising, a game board of checkerboard type having an imperforate, planar upper playing surface, two sets of playing pieces of only two different kinds, adapted to be placed on the game board, and those of each set being moved along the game board toward those of the other set in the playing of the game, the playing pieces of the two sets being respectively identical rings and identical pegs capable of being interfitted to form a playing piece unit, each ring having opposite parallel flat side surfaces and being symmetrical relative to a central plane between and parallel with the flat side surfaces, each peg being longer than the thickness of the ring and being symmetrical relative to a central plane that is perpendicular to the longitudinal axis of the peg, and the playing pieces being capable of being so interfitted by insertion of either end of a peg into a ring from either side of the ring, the playing pieces having means for limiting insertion of the peg into the ring substantially to an extent not more than half the thickness of the ring and for holding interfitted pieces together and the peg thereby, because of the relative dimensions and proportions of the playing pieces extending beyond the ring on one side of the ring, the playing pieces being of such relative proportions that when a playing piece unit is set on the playing board with either piece lowermost and the other piece in elevated position relative thereto, the unit is held stable on the playing board.

2. A game according to claim 1 wherein, the means for holding the interfitted pieces together includes relative dimensions of the pieces to produce friction between the pieces.

3. A game according to claim 1 wherein, the means for holding the playing pieces of the unit in interfitted position includes a rib on the inner surface of the ring at an intermediate position axially of the ring engageable by the peg.

4. A game according to claim 1 wherein, the playing pieces can be fitted together in such arrangement that a playing piece unit includes a single ring and a pair of pegs fitted in the ring and extending oppositely beyond the corresponding surfaces of the ring, and the outer end of each peg is of sufficiently great transverse dimensions that the playing piece unit is stable with either peg constituting the lowermost piece.

5. A game according to claim 1 wherein, the playing pieces can be fitted together in such arrangement that a playing piece unit includes a single peg and a pair of rings fitted on the ends of the peg, and the axially outer surface of each ring is of sufficiently great transverse dimension that the playing piece unit is stable with either ring constituting the lowermost piece.

6. A game according to claim 1 wherein, the ring has a center hole of a diameter substantially equal to the radius of the ring, and a thickness equal to that radius, and the peg has a diameter equal to the diameter of the hole in the ring, and a length equal to the diameter of the ring.

* * * * *